United States Patent [19]

DeLigt et al.

[11] Patent Number: 4,505,090

[45] Date of Patent: Mar. 19, 1985

[54] METHOD AND APPARATUS FOR WRAPPING PAPER ROLLS

[75] Inventors: John DeLigt; Willem A. Nikkel, both of Covington, Va.

[73] Assignee: Westvaco Corporation, New York, N.Y.

[21] Appl. No.: 970,221

[22] Filed: Dec. 18, 1978

[51] Int. Cl.[3] ..... B65B 49/08; B65B 61/00

[52] U.S. Cl. ..... 53/137; 53/415; 53/222

[58] Field of Search ..... 53/441, 469, 466, 487, 53/488, 453, 291, 294, 137, 221, 222, 345, 347, 357, 358, 556, 559, 580, 586

[56] References Cited

U.S. PATENT DOCUMENTS

| | | | |
|---|---|---|---|
| 594,663 | 11/1897 | Swinnerton | 53/580 |
| 1,612,262 | 12/1926 | Coggins et al. | 53/214 |
| 1,689,430 | 10/1928 | Gwinn | 53/469 |
| 1,871,765 | 8/1932 | Williamson | 53/137 |
| 2,008,802 | 7/1935 | Staner | 53/357 |
| 2,012,304 | 8/1935 | Dixon | 53/176 |
| 2,212,712 | 8/1940 | Klein et al. | 53/358 |
| 2,218,293 | 10/1940 | Muller | 53/580 X |
| 2,572,704 | 10/1951 | Edgerton | 53/357 X |
| 2,615,200 | 10/1952 | Cloud | 53/453 |
| 2,674,074 | 4/1954 | Lancaster | 53/137 |
| 3,393,492 | 7/1968 | Lamon | 53/137 |
| 4,201,028 | 5/1980 | Melehan | 53/380 |

FOREIGN PATENT DOCUMENTS

| | | | |
|---|---|---|---|
| 357935 | 10/1931 | United Kingdom | 53/357 |

*Primary Examiner*—John Sipos

*Attorney, Agent, or Firm*—W. A. Marcontell; R. L. Schmalz

[57] ABSTRACT

Large, paper mill reels of product are protectively wrapped for shipment by capping the reel ends with a header sheet of larger area than that reel end face circle to pleat a flange portion of the header sheet onto the cylindrical surface of reel with a resilient planar element having a freely suspended, circumferentially expansible aperture drawn coaxially over the header sheet and reel to wipe the header sheet flange onto the reel cylindrical surface.

2 Claims, 8 Drawing Figures

METHOD AND APPARATUS FOR WRAPPING PAPER ROLLS

BACKGROUND OF THE INVENTION

1. Field of the Invention

The present invention relates to the art of packaging or protectively wrapping large diameter reels of paper for transport.

2. Description of the Prior Art

The finished product of the papermaking process is a continuously issued web approximately twenty feet (6 meters) wide. For shipment to customers and converters, the web is slit into a multiplicity of more manageable widths and wound into cylindrical reels or rolls of normally three to six feet in diameter. Shipment weights of such reels may range from 1700 to 9200 pounds.

To protect such finished reels of paper from handling and shipment damage, the usual industry practice is to wrap the reels with a heavy grade of paperboard having a thickness caliper of 0.009 inch or greater.

The presently prevailing technique for such reel wrapping is to draw a strip of wrapping board from a supply reel of greater axial length than the reel to be protected. This web strip is wrapped tightly about the cylindrical surface of the protected reel. The axially overhanging portion is crimped radially inward toward the reel center and tightly creased against circular reel end. To seal the reel ends and hold the crimps down against the end faces, two circular header disks of approximately the same diameter as the protected reel are used at each reel end-face. One disk is inserted within the surface wrap overhang flush against the reel end-face. Adhesive is then applied to the outer face of this first or inner disk. Next, the overhanging portion of the surface wrap is crimped and pleated into the inner disk adhesive. Thereafter, a second or outer disk having adhesive applied to the inner face thereof is pressed against the outer face of the surface wrap pleats.

Common to all such prior art wrapping methods is the need for circular, usually die cut, header disks of substantially the same diameter as the reel. If several different diameter sizes are prepared for shipment by the producing mill, it is necessary to make, or purchase and store such respectively sized header disks preparatory to use.

Moreover, the mere need of several sizes of header disks creates a material handling obstacle at a reel wrapping station where several different reel sizes are wrapped in mixed succession. As the reel is circumferentially wrapped, the operator must select the proper disk size and manually place it against the reel end-face within the overhanging flange of wrapping material that is to serve as the crimped pleats.

Although these tasks are neither difficult nor excessively time consuming under relaxed conditions, in many cases the papermachine produces more rapidly than the product can be wrapped: even with the aid of semiautomatic equipment.

Another prior art reel wrapping technique was apparently first disclosed by A. W. Coggins et al in their 1926 U.S. Pat. No. 1,612,262. This Coggins et al wrapping technique requires a header sheet that is larger than the reel end face thereby leaving a peripherial flange that is pleated over onto the cylindrical surface of the reel. Subsequently, a girth wrap is applied about the reel circumference over the pleated header sheet flanges. Although dormant for many years, the Coggins et al wrapping technique has recently proven to have numerous advantages over the other, more familiar, technique. First, there is little criticality to the header size thereby permitting one size of header to accommodate a wide range of reel sizes. Second, it is not necessary for the header to be circular thereby permitting square or rectangular header shapes which may be cut by automatic machinery from supply rolls with no waste disposal. Third, there is one less step in the reel wrapping sequence thereby permitting a faster cycle rate. Finally, the technique is adaptable to automatic application machinery which simultaneously creases the header over the entire circumference of the reel end face corner and onto the cylindrical surface of the reel as opposed to an incremental pleating advanced serially around the reel circumference. The copending application of the present co-inventor John DeLigt, Ser. No. 833,300 filed Sept. 14, 1977, discloses a machine of the type described.

In view of the recent rediscovery of the Coggin's et al wrapping technique, no machinery aside from the aforedescribed DeLigt machine is presently available to practice the technique. This circumstance exists notwithstanding the fact that the Coggins et al method is most adaptable to practice by automatic machinery.

It is therefore, an object of the present invention to teach a novel method of practicing the Coggins et al reel wrapping technique.

Another object of the present invention is to teach the construction of novel machinery to practice the present invention method.

BRIEF DESCRIPTION OF THE DRAWING

Relative to the drawing wherein like reference characters designate like or similar mechanical elements throughout the several figures of the drawing.

SUMMARY

These and other objects of the invention are accomplished with an apparatus including a resilient or elastomer planar element such as a sheet of rubber that is secured at the outer periphery to a ring element of greater diameter than that of the reel to be wrapped. A freely suspended aperture in the planar element of less diameter than the reel to be wrapped is provided centrally of planar element.

When a header sheet is positioned adjacent the reel end face and the ring element having the resilient planar element secured thereto is drawn coaxially against the header sheet and over the reel, the planar element yields radially to enlarge the central aperture as the header sheet is simultaneously creased about the entire periphery of the reel end face corner with the cylindrical surface. Such drawing is continued until the end plane of the reel penetrates the aperture whereupon the axial drawing is reversed to relax the radial stress in the planar element for that annular portion of the planar element radially beyond the reel cylindrical surface. The remaining or inner annular portion of the planar element constricts into a circumferentially stressed tube about the reel girth which presses the header flange tightly against the cylindrical surface and into a band of adhesive applied previously thereto.

Continued reverse axial movement of the ring element peels the constricting tube from the cylindrical surface in a rolling motion.

Other embodiments of the invention comprise a planar element constructed in a spider-web fashion with two or more circular tension springs of different diameter and, if desired, spring rate, secured concentrically together by radially extended cable elements.

Another embodiment of the invention includes straight line tension springs stretched across respective chords of the ring element to leave a faceted circular opening therewithin. When the ring element comprises two adjacent counter-rotatable rings, opposite distal ends of the tension springs are attached to respective rings. By relatively rotating the two coaxially adjacent rings, the effective diameter of the central opening may be adjusted in the manner of an iris.

DESCRIPTION OF THE PREFERRED EMBODIMENTS

Figure 1:
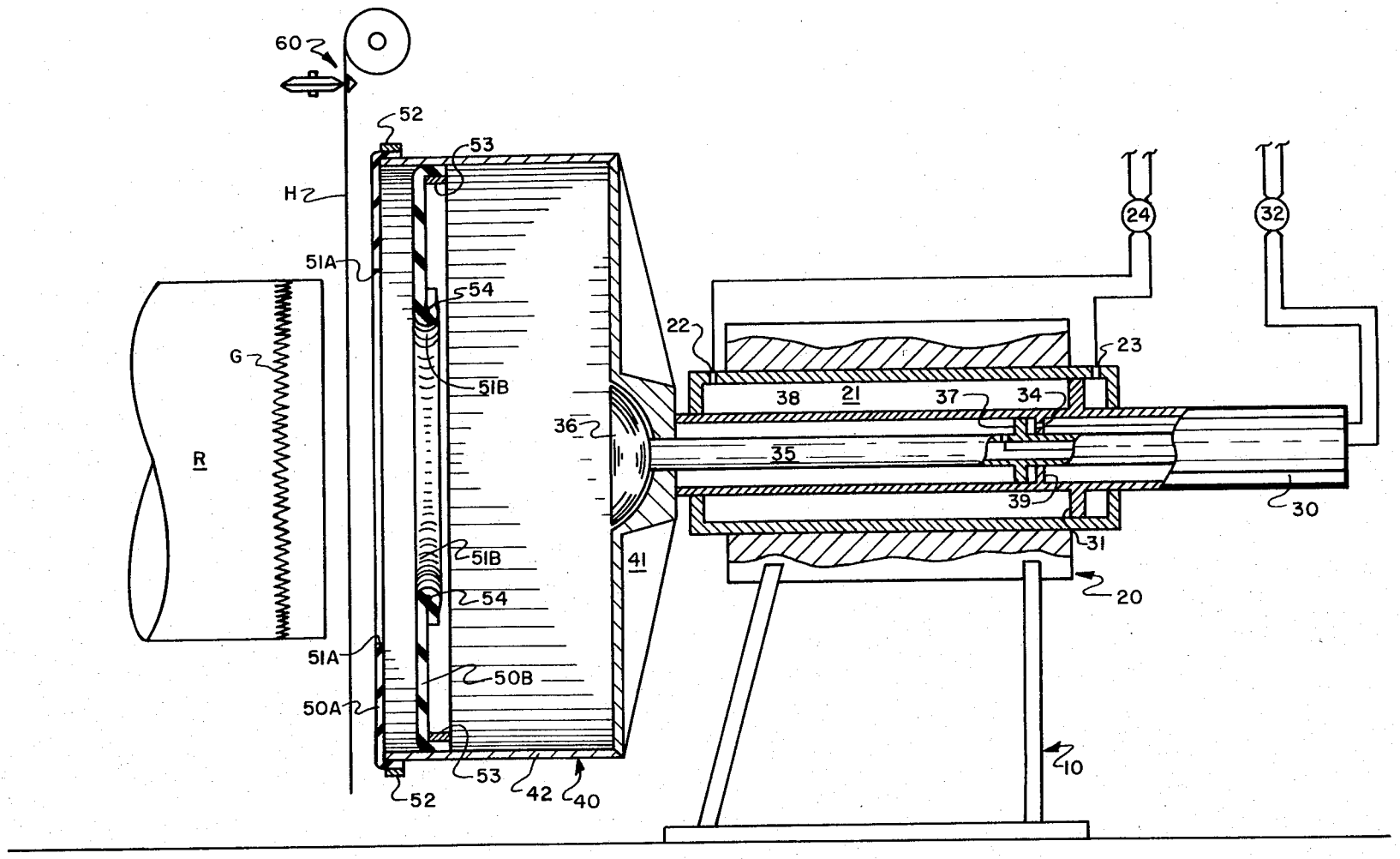
FIG. 1 is a sectional elevation of a reel heading machine embodying the principles of the present invention.
Figure 2A:
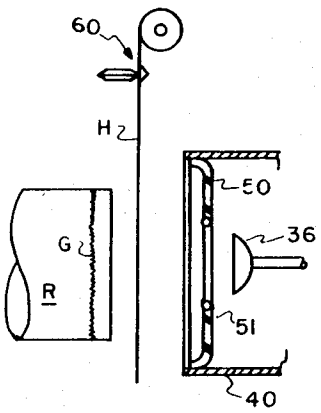
FIG. 2 is an operating sequence schematic of steps A through G representing the present invention method.
Figure 2B:
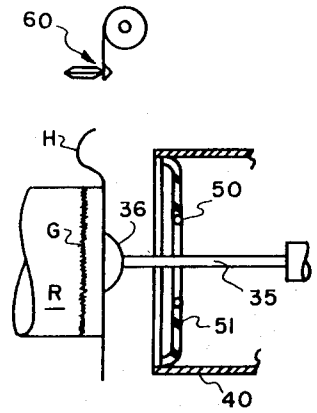
Figure 2C:
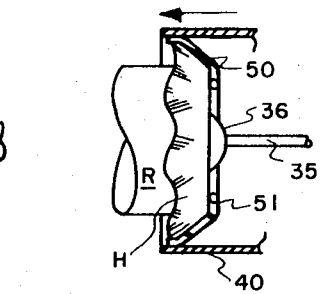
Figure 2D:
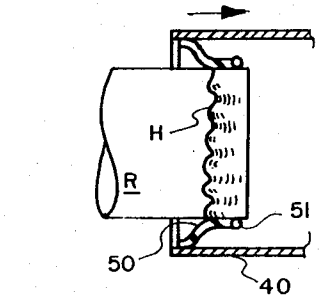
Figure 2E:
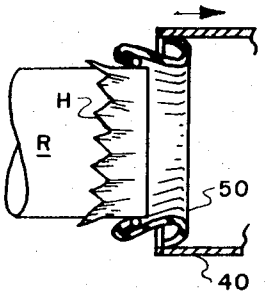
Figure 2F:
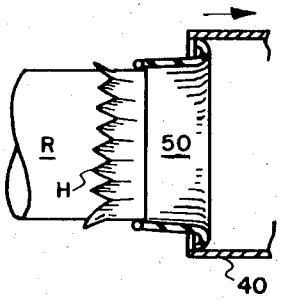
Figure 2G:
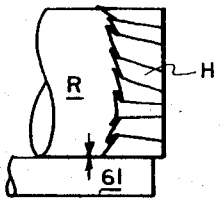

The apparatus of FIG. 1 represents a structural framework suitable for supporting and operating any of the invention species disclosed herein. Although a centrally apertured rubber diaphragm embodiment of the invention is shown, those of ordinary skill will understand that the other embodiments to be subsequently described may be substituted in the FIG. 1 header framework conjunctive with or in lieu of this rubber diaphragm embodiment.

Each header unit generally comprises a pedestal 10, a collar 20, a header loading strut 30 and a header pan 40. A complete reel header station will comprise two such header units in oppositely facing disposition as described in copending application Ser. No. 833,300.

One or both of the pedestals 10 may be mounted for movement of the entire respective header unit along a line parallel with the reel R axis for accommodating large differences between reel lengths.

Collar element 20 is secured as a rigidly integral element of the pedestal 10. Internally of the collar element is a fluid cylinder 21 with fluid conduit ports 22 and 23 at opposite ends thereof. A four-way valve 24 controls the ingress and egress of working fluid relative to two displacement chambers respective to opposite axial ends of the cylinder 21.

Extending axially through the cylinder 21 is the header loading strut 30 having a collar piston 31 secured thereto within the chamber of cylinder 21. One axial end of the strut 30 is secured to the load distribution platen 41 of the header pan 40.

Coaxially disposed within the loading strut 30 is the extension rod 35 for the header sheet clamp 36. Collar piston 37 rigidly secured to the rod 35, extends and retracts the rod 35 and clamp 36 before the pressure front of fluid admitted to cylinder 38 within the hollow core of strut 30. A bulkhead 39 heads off one end of the cylinder 38 whereas the shoulder boss of platen 41 heads off the other end of cylinder 38. Four-way valve 32 controls the flow of pressurized fluid relative to the opposite chamber ends of cylinder 38 via conduit ports 33 and 34.

Ring element 42 of the header pan 40 is shown as a short section of hollow cylinder. However, any structural configuration that will support the outer periphery of the apertured diaphragms 50A and 50B will suffice. The peripherial walls of cylinder 42 are not required to confine pressure.

The FIG. 1 embodiment illustrates two diaphragms 50A and 50B, each for a respective diametric size range for mill rolls R. These diaphragms are preferably fabricated from 30 to 50 Shore "A" durometer hardness, 0.0625 to 0.125 inch thick natural gum rubber sheet stock having at least 600% elongation. The cut shape of the diaphragms 50A and 50B is simply as a circle with a concentrally located, freely suspended circular aperture 51A and 51B, respectively. The subsequent description of the invention operation will reveal those characteristics and parameters necessary to dimension the aperture. The outer periphery of each diaphragm is approximately secured about the circumference of the cylinder 42 such as by hoop clamps 52 and 53. The aperture periphery may be left as a smooth cut edge as shown on diaphragm 50A or rolled back upon itself and adhesively bonded to form a circumferential tube 54 shown on diaphragm 50B.

Unit 60 schematically represents a reeled supply of header sheet material H and cutting means to sever a desired length of header material H from the remaining reel.

FIG. 2 schematically illustrates the operational sequence of the invention starting with step A wherein the reel R is positioned coaxially between the oppositely facing header units. From the header supply unit 60, a sufficient length of header sheet material H is drawn from the supply reel and draped between the reel and the open face end of the header unit. A substantially continuous bead of adhesive G is applied around the reel R periphery near each of the roll end faces.

Step 2B in the operation shows the clamp 36 and rod 35 to be extended against the header sheet H and the reel R end face for temporarily securing the header sheet position after severance from the header supply unit 60.

In step 2C, the header pan 40 is extended concentrically over the reel R end against the resilient bias of the apertured rubber diaphragm 50. As the diaphragm 50 yields longitudinally and radially, the flange of header sheet H comprising that header material beyond the radial periphery of the reel R is broken, i.e. creased, over the reel end-face corner and gathered or pleated onto the circumferential surface of the reel R. When sufficiently drawn, axially, over the reel R end face, the diaphragm aperture 51 will expand over the end-face corner to completely encircle the reel R as shown by Step 2D.

Figure 3:
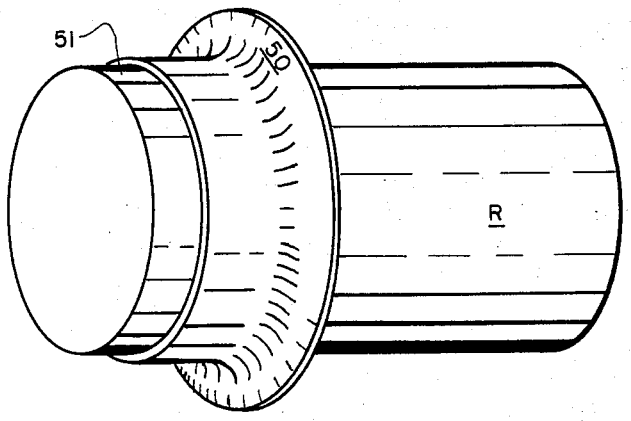
FIG. 3 is a pictorial representation of one embodiment of the invention corresponding to method step 2D.

It will also be noted from the step 2D illustration that when the axially directed stress (relative to the reel R axis) within the diaphragm 50 is relaxed by a partial retraction of the pan 40 ring, the originally planar diaphragm will tubularly constrict against the reel circumferential surface to radially press the header sheet H flange into the adhesive band G. FIG. 3 pictorially illustrates the geometry of this circumstance and condition of the diaphragm 50. A static stress analysis of this tubular constricting portion of the diaphragm will disclose the greatest tensile hoop stress located at the aperture 51 edge and diminishing axially along the tube until a neutral diaphragm radius is reached coinciding with the reel R radius.

Figure 4:
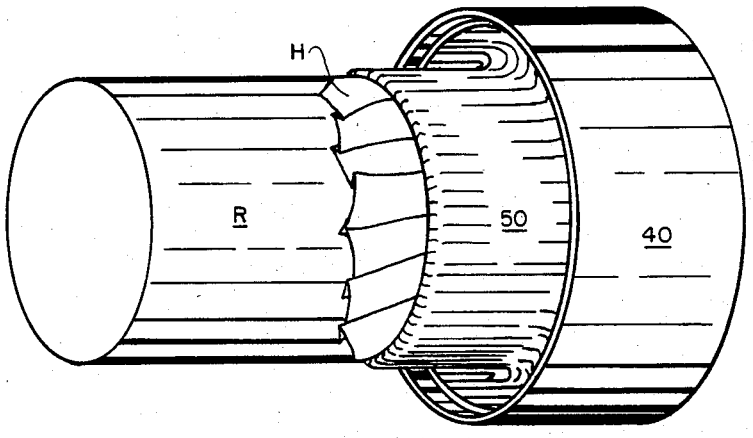
FIG. 4 is a pictorial representation of one embodiment of the invention corresponding to method step 2E.

As the retraction of header pan 40 continues, the step 2E illustration shows the tubular, hoop stressed portion of the diaphragm 50 to be inverted by rolling upon itself. This action is further illustrated pictorially by FIG. 4. Consequently, the axial forces along the reel surface tending to slide or shear the pleated header sheet H off the smooth cylindrical surface of the reel R are minimized and easily overcome by the adhesive band G into which the header sheet H has been pressed.

An axially directed (reel axis) frictional drag will not occur during retraction of header pan 40 until the diaphragm tube is completely inverted as shown at step illustration 2F. If the initial drawing stroke of the pan 40 is carefully regulated and limited so as to minimize the axial penetration of the aperture 51 by the reel R end, such drag forces will not displace the header sheet H but tend to continue the roll over the reel end-face corner.

Alternatively, there is no compulsion that the diaphragm aperature 51 be actually penetrated by the reel R end. If this approach is taken, the tubular inversion roll will continue over the brink of the end-face corner edge.

The end result of the previously described steps is a loosely wiped and pleated header sheet over the respective reel R end-faces. To better secure the header pleats, the weight of the reel R is cradled between two press rolls 61 and rotated as shown by step illustration 2G. The resulting nip between the reel R and rolls 61 creases the header sheet H along the pleat fold lines and presses the under side of the header flange tightly into the adhesive band G.

The characteristic principles of the foregoing method may be carried out by at least two other apparatus designs as represented by FIGS. 5 and 6 and FIGS. 7 and 8, respectively.

Figure 6:
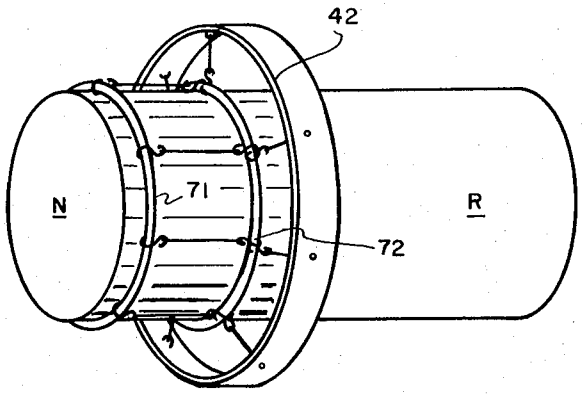
FIG. 6 is a pictorial representation of the FIG. 5 embodiment of the invention.
Figure 5:
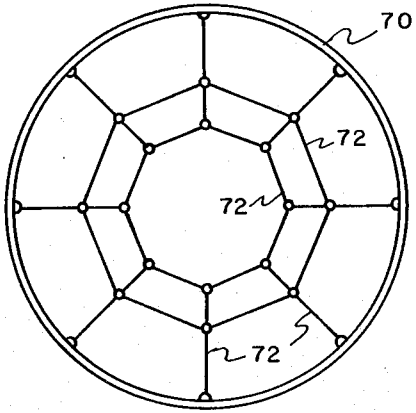
FIG. 5 is a front elevational schematic of a second embodiment of the invention.

The embodiment of FIGS. 5 and 6 provides two circular tension springs 71 and 72 connected at uniform circular increments around the circumference thereof by radial lengths 73 of cable, rope or chain. Further references to cable will impliedly include rope, chain and such other mechanical equivalents. The radially outer end of the cables are secured to header ring 42.

Use of the FIGS. 5 and 6 embodiment is substantially the same as the FIG. 1 embodiment with all other structural elements of the header unit remaining the same. An advantage of the FIGS. 5 and 6 embodiment resides in the design flexibility of distinct spring elements 71 and 72 to apply a uniform constrictive force at opposite ends of the cable tube formed from the original spiderweb planar configuration as it is wiped over the roll end. Such uniform constructive forces may be achieved by a discrete selection of spring rates respective to the two springs 71 and 72 so that the constrictive force on the reel R circumference at the inner and outer circumferential lines of the two springs are substantially the same: a result that could not be achieved with a homogenous sheet of rubber as described in diaphragm 51A. Obviously, other constrictive force assignments for the two springs 71 and 72 may be selected by the same expedient of spring rate selection.

Figure 8:
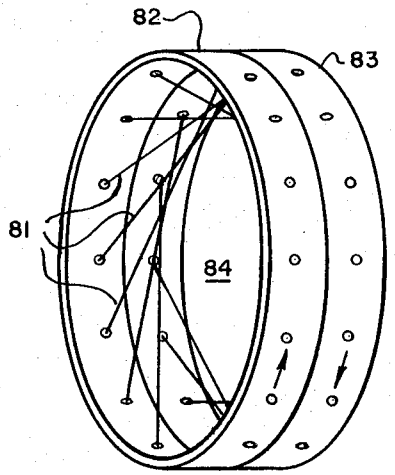
FIG. 8 is a pictorial representation of the FIG. 7 embodiment of the invention.
Figure 7:
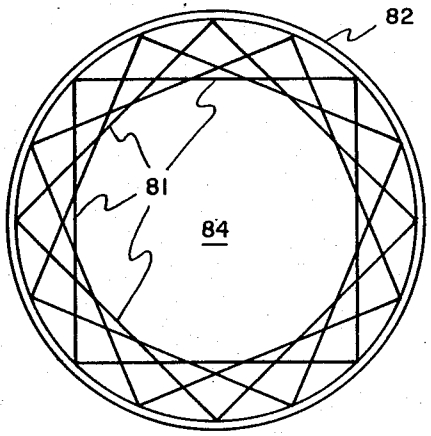
FIG. 7 is a front elevational schematic of a third embodiment of the invention.

The embodiment of FIGS. 7 and 8 provides a multiplicity of straight line-tensile springs 81 drawn across circular chords and between two, counter-rotatable ring elements 82 and 83 to form a central iris aperture 84. By rotating the ring elements 82 and 83 the springs 81 stretch across respective chords of variable arc to collectively open or close the central opening. This device provides a rapid aperture adjustment capacity and permits the opening through the springs to be quickly tailored to fit the particular diameter of the roll R at hand.

As in the previous two embodiments of the invention, the aperture 84 will preferably be set to a slightly smaller opening area or diameter than the circular section of reel R. Consequently, as the chords 81 are stretched to accommodate the larger diameter reel R, those portions of the chords having engagement with the reel surface will constitute segments of a helix on a tube surface due to the axial displacement between the distal ends of the chords. This circumstance may be exploited by rotating the reel R or the collective ring element formed by respective elements 82 and 83 non-rotatively locked together. Consequently, the header sheet H flange may be screwed onto the cylindrical surface of reel R and header unit removed by reversing the rotation.

Having fully described our invention, those of ordinary skill in the art will readily recognize other embodiments and variations thereof within the scope of obvious mechanical equivalency. As our invention, therefore,

We claim:

1. An apparatus for applying sheets of header wrapping material over circular ends of various diameter cylindrical mill reels of paper comprising:

A. Axially reciprocable ring frame means of greater inside radius than the largest circular radius of said cylindrical mill reels having a pair of axially adjacent, counterrotatable ring elements; and, B. Circumferentially resilient aperture means comprising a plurality of resilient, straight line tensile elements stretched across respective chords of a circular opening within said ring elements, opposite distal ends of said straight line elements being secured to respective ones of said counterrotatable ring elements whereby an axially central iris opening formed by said straight line elements constitutes a freely suspended aperture within said ring frame means of less inside radius than the smallest circular radius of said reels.

2. An apparatus for applying sheets of header wrapping material over circular ends of cylindrical articles comprising:

A. Axially reciprocable ring frame means comprising counter-rotatable ring elements of greater inside radius than a circular radius of said cylindrical articles; and, B. A plurality of resilient, straight line tensile elements stretched across respective chords of a circular opening within said ring elements, opposite distal ends of said straight line elements being secured to respective ones of said counter-rotatable elements to form a circumferentially resilient iris opening centrally within said ring opening.

* * * * *